US008630572B2

(12) United States Patent
Fujimoto et al.

(10) Patent No.: US 8,630,572 B2
(45) Date of Patent: Jan. 14, 2014

(54) FIXING DEVICE AND IMAGE FORMING APPARATUS INCLUDING SAME

(75) Inventors: Ippei Fujimoto, Kanagawa (JP); Hiroshi Yoshinaga, Chiba (JP); Tetsuo Tokuda, Kanagawa (JP); Takamasa Hase, Kanagawa (JP); Toshihiko Shimokawa, Kanagawa (JP); Kenji Ishii, Kanagawa (JP); Yoshiki Yamaguchi, Kanagawa (JP); Masaaki Yoshikawa, Tokyo (JP); Naoki Iwaya, Tokyo (JP); Takahiro Imada, Kanagawa (JP); Yutaka Ikebuchi, Kanagawa (JP); Kenichi Hasegawa, Kanagawa (JP); Akira Shinshi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 13/027,595

(22) Filed: Feb. 15, 2011

(65) Prior Publication Data

US 2011/0222929 A1 Sep. 15, 2011

(30) Foreign Application Priority Data

Mar. 11, 2010 (JP) ..... 2010-054558

(51) Int. Cl.
*G03G 15/20* (2006.01)

(52) U.S. Cl.
USPC ..... 399/329; 399/334; 399/338

(58) Field of Classification Search
USPC ..... 399/329
See application file for complete search history.

(56) References Cited

U.S. PATENT DOCUMENTS

| | | | | |
|---|---|---|---|---|
| 6,872,925 | B2 * | 3/2005 | Asakura et al. | 219/619 |
| 7,623,804 | B2 * | 11/2009 | Sone et al. | 399/69 |
| 7,869,753 | B2 | 1/2011 | Shinshi | |
| 2003/0170055 | A1 * | 9/2003 | Terada et al. | 399/328 |
| 2006/0099001 | A1 * | 5/2006 | Asakura et al. | 399/69 |
| 2006/0147221 | A1 * | 7/2006 | Asakura et al. | 399/69 |
| 2007/0041757 | A1 * | 2/2007 | Tajima et al. | 399/328 |
| 2007/0071523 | A1 * | 3/2007 | Suzuki | 399/329 |
| 2007/0292175 | A1 | 12/2007 | Shinshi | |
| 2008/0112739 | A1 | 5/2008 | Shinshi | |

(Continued)

FOREIGN PATENT DOCUMENTS

| | | |
|---|---|---|
| JP | 10-213984 | 8/1998 |
| JP | 2884714 B | 2/1999 |

(Continued)

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

A fixing device includes a nip forming member disposed inside a fixing member and pressed against a pressing member via the fixing member to form a nip portion between the pressing member and the fixing member through which a recording medium bearing a toner image passes. A heat generator disposed inside the fixing member heats the fixing member outside the nip portion and has variable heat distribution over a width of the fixing member. A first temperature detector disposed inside the fixing member contacts an end portion of the heat generator in the width direction of the fixing member, opposite a surface facing the fixing member, to detect a temperature of the heat generator. A second temperature detector disposed inside the fixing member contacts a center of an inner circumferential surface of the fixing member in the width direction, to detect the temperature of the fixing member.

10 Claims, 4 Drawing Sheets

(56) References Cited

U.S. PATENT DOCUMENTS

| | | | | |
|---|---|---|---|---|
| 2008/0175633 | A1 | 7/2008 | Shinshi | |
| 2008/0226324 | A1* | 9/2008 | Baba et al. | 399/69 |
| 2008/0260408 | A1* | 10/2008 | Takagi et al. | 399/69 |
| 2008/0298862 | A1 | 12/2008 | Shinshi | |
| 2008/0304882 | A1* | 12/2008 | Shin et al. | 399/329 |
| 2009/0311016 | A1 | 12/2009 | Shinshi | |
| 2010/0054786 | A1* | 3/2010 | Hara | 399/69 |
| 2010/0086324 | A1* | 4/2010 | Smith | 399/67 |
| 2010/0092220 | A1 | 4/2010 | Hasegawa et al. | |
| 2010/0092221 | A1 | 4/2010 | Shinshi et al. | |
| 2010/0142987 | A1* | 6/2010 | Sato | 399/69 |
| 2010/0202809 | A1 | 8/2010 | Shinshi et al. | |
| 2010/0290822 | A1 | 11/2010 | Hasegawa et al. | |
| 2011/0026987 | A1 | 2/2011 | Hasegawa | |
| 2011/0026988 | A1 | 2/2011 | Yoshikawa et al. | |
| 2011/0129268 | A1* | 6/2011 | Ishii et al. | 399/333 |
| 2011/0194870 | A1* | 8/2011 | Hase et al. | 399/69 |
| 2011/0206427 | A1* | 8/2011 | Iwaya et al. | 399/329 |

FOREIGN PATENT DOCUMENTS

| | | |
|---|---|---|
| JP | 2001-117412 | 4/2001 |
| JP | 3298354 B | 4/2002 |
| JP | 2002-182524 | 6/2002 |
| JP | 2002-333788 | 11/2002 |
| JP | 2005-321445 | 11/2005 |
| JP | 2007-334205 | 12/2007 |
| JP | 2008-158482 | 7/2008 |
| JP | 2008-216928 | 9/2008 |
| JP | 2009-237403 | 10/2009 |

* cited by examiner

FIXING DEVICE AND IMAGE FORMING APPARATUS INCLUDING SAME

CROSS-REFERENCE TO RELATED APPLICATIONS

The present application is based on and claims priority to Japanese Patent Application No. 2010-054558, filed on Mar. 11, 2010 in the Japan Patent Office, which is hereby incorporated herein by reference in its entirety.

BACKGROUND OF THE INVENTION

1. Field of the Invention

Exemplary aspects of the present invention relate to a fixing device and an electrophotographic image forming apparatus, such as a copier, a facsimile machine, a printer, or a multi-functional system including a combination thereof, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charging device uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a pair of looped belts or rollers, one being heated by a heater for melting toner (hereinafter referred to as "fixing member") and the other being pressed against the fixing member (hereinafter referred to as "pressing member"). In a fixing process, the fixing member and the pressing member meet and press against each other, forming a so-called a fixing nip through which a recording medium is passed to fix a toner image thereon under heat and pressure.

As the fixing member, a belt-type fixing member having a low heat capacity is used to reduce rise time. Although advantageous, it is difficult to adjust the temperature of such a fixing member evenly across the fixing member because, when heated, the temperature of the fixing member having a low heat capacity tends to change rapidly.

In order to obtain a desired temperature of the fixing member reliably, for example, in one related-art fixing device, a temperature detector is provided to detect the temperature of the heater and readings therefrom used to adjust the temperature of the fixing member. However, because the temperature of the fixing member is not detected directly but instead is detected indirectly via the heater, there is a delay in adjustment of the temperature of the fixing member and hence it is difficult to adjust the temperature of the fixing member evenly across the fixing member in a timely manner.

To counteract the delay, the temperature of the fixing member may be detected on the rear side of the fixing member. In this configuration, a contact-less temperature detector is used, to prevent the fixing member from getting damaged by the temperature detector. Disadvantageously, such a contact-less temperature detector is generally expensive.

In another example of detecting the temperature of the fixing member, when using a ceramic heater as a heat source, multiple temperature detectors for detecting the temperature of the ceramic heater are disposed in a recording medium passing area defined on the fixing member and through which a recording medium is conveyed. More specifically, the temperature detectors are disposed on the rear side of the ceramic heater at a center of the recording medium passing area over which any size of the recording medium is subjected to pass and at an end portion of the recording medium passing area over which a largest size of the recording medium passes.

In this configuration as well, the temperature of the fixing member is adjusted indirectly by detecting the temperature of the rear side of the ceramic heater. As a result, temperature ripple of the fixing member tends to be significant, complicating efforts to adjust the temperature of the fixing member reliably.

In order to reduce the temperature ripple of the fixing member, it is desirable to adjust the temperature of the fixing member by detecting the temperature of the fixing member directly. However, as described above, direct detection of the fixing member may cause damage to the fixing member, or the temperature detector is expensive. To address such a difficulty, detection of the temperature of the heater is proposed instead. Disadvantageously, however, if the temperature of the heater is detected at a distance while rotation of the fixing member is halted, detection of the temperature thereof is delayed, causing overheating. Furthermore, if the temperature of the fixing device is adjusted indirectly, that is, the temperature of the fixing device is adjusted by adjusting the temperature of the heater, there is a delay in transmission of heat, thereby increasing temperature ripple.

Moreover, detection of the temperature of the fixing member at a place other than a place contacting the heater also causes a delay in detection of the temperature of the fixing member when the fixing member is not rotated. That is, because the fixing member is generally made thin to have a small heat capacity to enable quick start, heat transmission in a circumferential direction thereof is small. Hence, there is a significant temperature difference in the fixing member between the contact place contacting the heater and the non-contact place.

In order to detect the temperature of the fixing member properly and reliably when the fixing member is still, it is desirable to have a temperature detector at the contact place where the fixing member comes in contact with the heater. Furthermore, when a recording medium having a narrow width is fed into the nip, the temperature of the fixing member at a non-recording medium passing area is overheated because there is no recording medium to absorb the temperature of the fixing member at that portion of the fixing member.

In view of the foregoing, it is desirable to provide a plurality of heaters to change heat generation distribution over the width of the fixing member to accommodate recording media sheets in different sizes. In this configuration, the temperature detectors need to be disposed at each heat-generating area to adjust temperature of the heat-generating areas independently.

There is a drawback to this configuration in that a plurality of temperature detectors is needed. More specifically, at least four temperature detectors are needed to detect the temperature of the center and lateral end portions of the heater in the width direction and in the circumferential direction as well at as places other than where the heater is disposed.

BRIEF SUMMARY OF THE INVENTION

This specification describes below an improved fixing device.

In view of the foregoing, in one illustrative embodiment of the present invention, a fixing device for fixing a toner image on a recording medium includes an endless belt-shaped fixing member, a pressing member, a nip forming member, a heat generator, a first temperature detector, and a second temperature detector. The endless belt-shaped fixing member formed in a loop rotates in a predetermined direction and conveys the recording medium. The pressing member is disposed opposite the fixing member and presses against the fixing member to contact an outer circumferential surface of the fixing member. The nip forming member is disposed inside the loop formed by the fixing member and contacts the pressing member through the fixing member to form a nip portion between the pressing member and the fixing member through which the recording medium bearing the toner image passes. The heat generator is disposed inside the loop formed by the fixing member outside the nip portion and heats the fixing member. The heat generator has variable heat distribution over a width of the fixing member. The first temperature detector is disposed inside the loop formed by the fixing member and contacts a lateral end portion of the heat generator in the width direction of the fixing member opposite a surface facing the fixing member, to detect a temperature of the heat generator. The second temperature detector is disposed inside the loop formed by the fixing member and contacts a lateral center portion of an inner circumferential surface of the fixing member in the width direction, to detect the temperature of the fixing member.

In another illustrative embodiment of the present invention, an image forming apparatus includes an image carrier, a developing device, a transfer device, and a fixing device. The image carrier bears an electrostatic latent image on a surface thereof. The developing device develops the electrostatic latent image formed on the image bearing member using toner to form a toner image. The transfer device transfers the toner image onto the recording medium. The fixing device fixes the toner image on the recording medium. The fixing device includes an endless belt-shaped fixing member, a pressing member, a nip forming member, a heat generator, a first temperature detector, and a second temperature detector. The endless belt-shaped fixing member formed in a loop rotates in a predetermined direction and conveys the recording medium. The pressing member is disposed opposite the fixing member and presses against the fixing member to contact an outer circumferential surface of the fixing member. The nip forming member is disposed inside the loop formed by the fixing member and contacts the pressing member through the fixing member to form a nip portion between the pressing member and the fixing member through which the recording medium bearing the toner image passes. The heat generator is disposed inside the loop formed by the fixing member outside the nip portion and heats the fixing member. The heat generator has variable heat distribution over a width of the fixing member. The first temperature detector is disposed inside the loop formed by the fixing member and contacts a lateral end portion of the heat generator in the width direction of the fixing member opposite a surface facing the fixing member, to detect a temperature of the heat generator. The second temperature detector is disposed inside the loop formed by the fixing member and contacts a lateral center portion of an inner circumferential surface of the fixing member in the width direction, to detect the temperature of the fixing member.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF THE INVENTION

Figure 1:
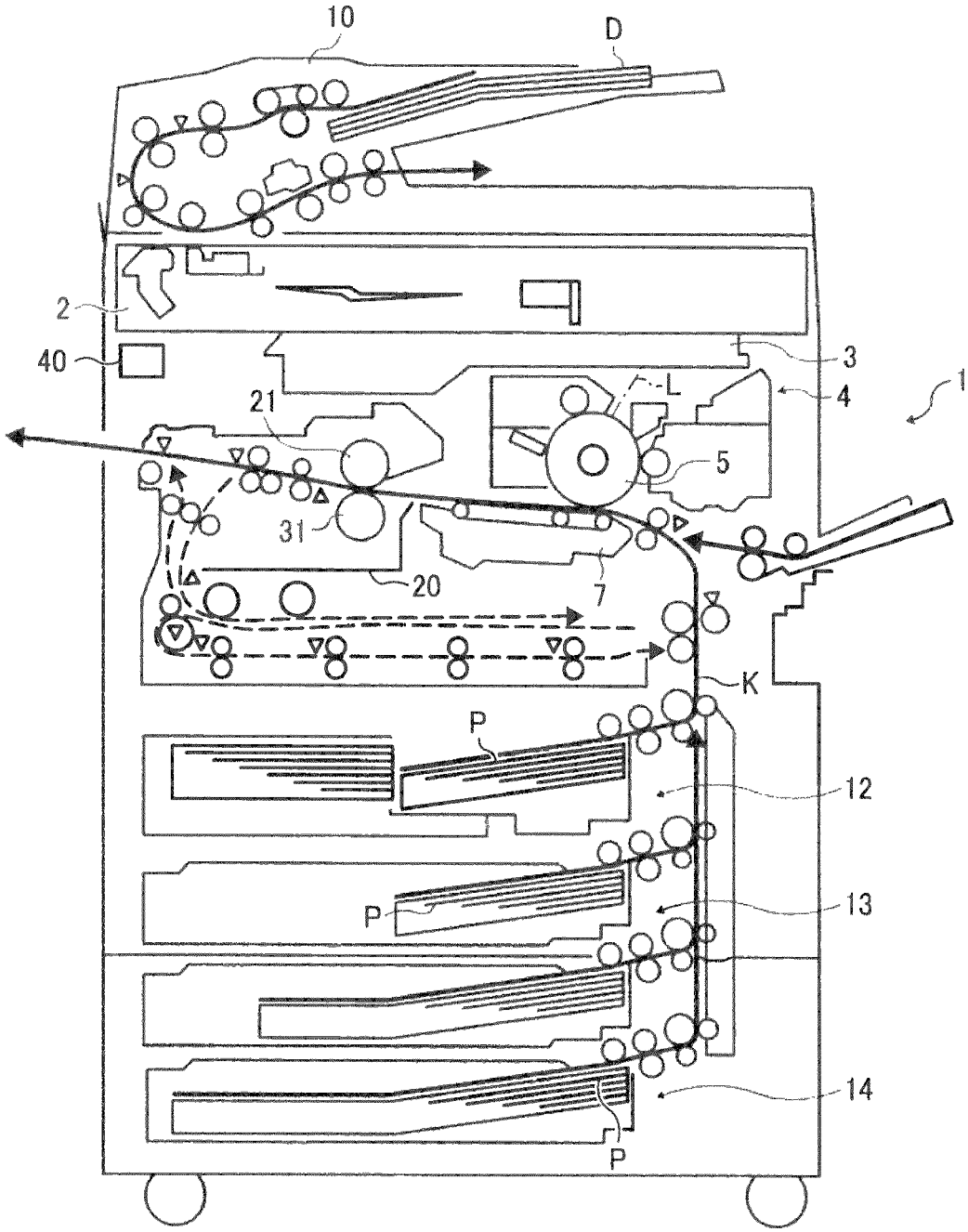
FIG. 1 is a schematic diagram illustrating an image forming apparatus according to an exemplary embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms “a”, “an” and “the” are intended to include the plural forms as well, unless the context clearly indicates otherwise. Moreover, the terms “includes” and/or “including”, when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, in particular to FIG. 1, an image forming apparatus according to an exemplary embodiment of the present invention is explained.

Referring to FIG. 1, there is provided a schematic diagram illustrating a color copier as an example of the image forming apparatus which employs a fixing device according to the illustrative embodiment of the present invention.

In FIG. 1, the image forming apparatus includes a main body 1 having a copying function, a document reader 2, an exposure device 3, an image forming unit 4, a transfer device 7, a document conveyer 10, sheet cassettes 12, 13, and 14, and a fixing device 20.

The document reader 2 reads optically image information of an original document D placed on an upper portion of the image forming apparatus. The exposure device 3 illuminates a photoconductive drum 5 serving as an image carrier in the image forming unit 4 with exposure light L based on the image information read by the document reader 2. The image forming unit 4 forms a toner image on the photoconductive drum 5. The transfer device 7 transfers the toner image formed on the photoconductive drum 5 onto a recording medium P. The document conveyer 10 conveys the original document D set in the document conveyer 10 to the document reader 2. The sheet cassettes 12, 13, and 14 store multiple recording media sheets such as transfer sheets. The fixing device 20 includes a fixing belt 21 and a pressing roller 31, to fix the toner image, that is, an unfixed image on the recording medium P.

With reference to FIG. 1, a description is provided of general image forming operation. The original document D is conveyed in a direction indicated by an arrow by conveyance rollers and passes above the document reader 2. The document reader 2 reads optically the image information of the original document D passing above the document reader 2.

The image information read optically by the document reader 2 is converted into electrical signals and then transmitted to the exposure device 3 serving as an optical writer. Subsequently, the exposure device 3 illuminates the photoconductive drum 5 of the image forming unit 4 with the exposure light L such as a laser beam or the like based on the electrical signals representing the image information.

In the image forming unit 4 including a developing device, the photoconductive drum 5 is rotated in a clockwise direction in FIG. 1. After imaging processes such as a charging process, an exposure process, and a development process, an image (toner image) corresponding to the image information is formed on the photoconductive drum 5. Subsequently, in the transfer device 7, the toner image formed on the photoconductive drum 5 is transferred onto the recording medium P conveyed by registration rollers.

The recording medium P conveyed to the transfer device 7 is fed from one of the sheet cassettes 12, 13, and 14 of the main body 1. One of the sheet cassettes 12, 13, and 14 is selected either automatically or manually. For example, when the sheet cassette 12 which is the uppermost sheet cassette is selected, the top sheet of the recording media sheets stored in the sheet cassette 12 is conveyed to a sheet conveyance path K.

Subsequently, the recording medium P arrives at the registration rollers after passing through the sheet conveyance path K. The recording medium P is temporality stopped by the registration rollers, and conveyed again to the transfer unit 7 with an appropriate timing such that the recording medium P is aligned with the image on the photoconductive drum 5.

After the transfer process, that is, after the recording medium P passes through the transfer device 7, the recording medium arrives at the fixing device 20 through the sheet conveyance path K. Arriving at the fixing device 20, the recording medium P is conveyed to a fixing nip where the fixing belt 21 and the pressing roller 31 meet and press against each other. In the fixing nip, heat supplied by the fixing belt 21 and pressure supplied by the fixing belt 21 and the pressing roller 31 fix the toner image on the recording medium P. After the toner image is fixed, the recording medium is discharged from the fixing nip between the fixing belt 21 and the pressing roller 31, and is discharged from the main body of the image forming apparatus, thereby finishing a sequence of the image forming process.

Figure 2B:
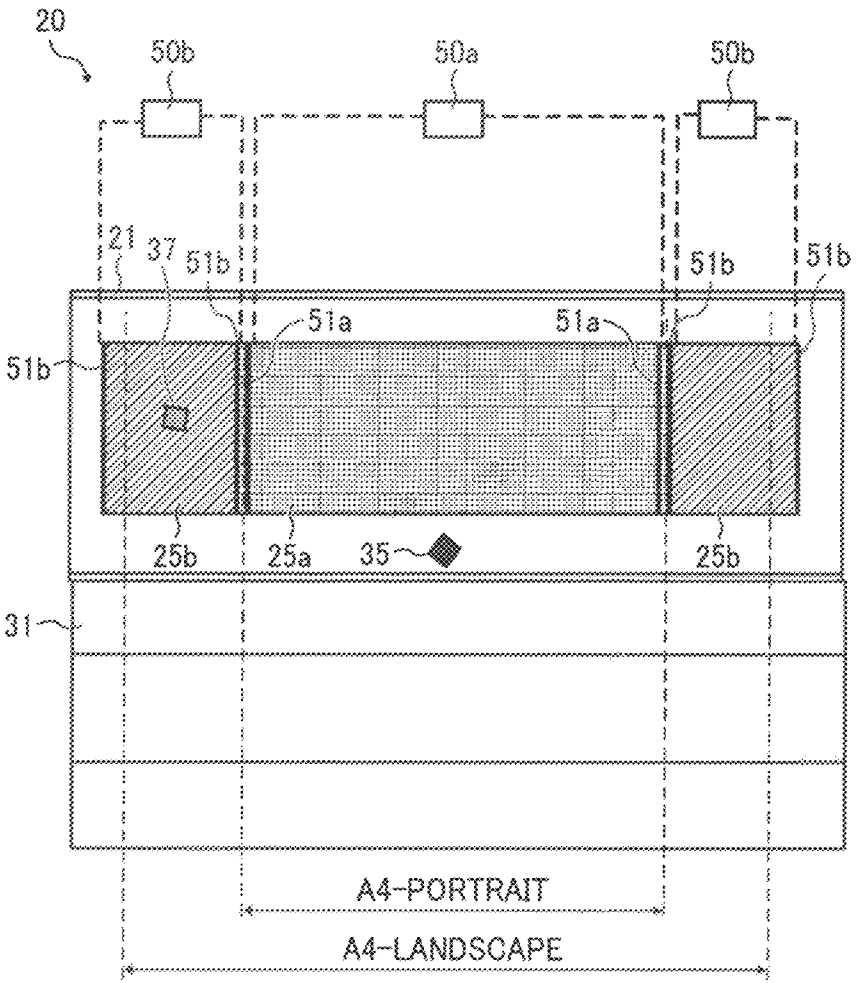
FIG. 2 is a schematic diagram illustrating a fixing device employed in the image forming apparatus shown in FIG. 1.
Figure 2A:
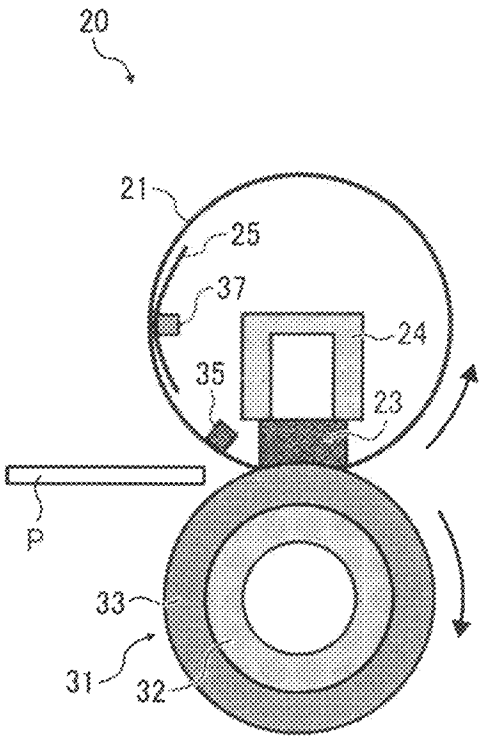

With reference to FIG. 2, a description is provided of the fixing device 20 according to the illustrative embodiment. FIG. 2A is a schematic cross-sectional diagram illustrating the fixing device 20 in the circumferential direction. FIG. 2B is a top view of the fixing device 20 in the axial direction. The fixing device 20 includes the fixing belt 21, the pressing roller 31, a nip forming member 23, a reinforcing member 24, a heat generator 25, a first temperature detector 37, and a second temperature detector 35.

The fixing belt 21 serving as a fixing member is a flexible endless belt formed into a loop that heats and melts the toner image while rotating in a predetermined direction. The pressing roller 31 serving as a rotary pressing member is disposed opposite the fixing belt 21 and presses against the fixing belt 21. The nip forming member 23 is disposed inside the inner loop formed by the fixing belt 21, to contact the pressing roller 31 through the fixing belt 21, thereby forming a nip between the fixing belt 21 and the pressing roller 31. The heat generator 25 is disposed inside the inner loop formed by the fixing belt 21 at a position outside the nip portion with a predetermined clearance from the inner circumferential surface of the fixing belt 21, or the heat generator 25 is disposed inside the inner loop of the fixing belt 21, to contact the fixing belt 21 at a predetermined pressure.

The first temperature detector 37 is disposed at an end portion of the fixing belt 21 in a width direction thereof inside the loop formed by the fixing belt 21 and contacts the surface of the heat generator 25 opposite the surface contacting the fixing belt 21. The second temperature detector 35 is disposed substantially at a center portion of the fixing belt 21 in the width direction inside the loop of the fixing belt 21, to contact the inner circumferential surface of the fixing belt 21.

It is to be noted that the circumferential direction of the fixing belt 21 refers to a direction of rotation of the fixing belt 21. The width direction refers to an axial direction of the fixing belt 21. The center portion of the fixing belt 21 in the width direction is within the recording medium passing area over which a recording medium in any size passes. By contrast, the end portion of the fixing belt 21 in the width direction may be in the recording medium passing area for only a relatively large recording medium depending upon the size of the recording medium.

The heat generator 25 includes two heat generating portions, that is, a first heat generator 25*a* and a second heat generator 25*b*, to change a distribution of heat generation across the width of the fixing belt 21. More specifically, when the fixing belt 21 is not rotated, the temperature of the fixing belt 21 is adjusted based on a detection result provided by the first temperature detector 37. By contrast, when the fixing belt 21 is rotated, the temperature of the fixing belt 21 is adjusted based on a detection result provided by the second temperature detector 35.

The fixing belt 21 is a thin, flexible endless belt formed into a loop that is rotated in a counterclockwise direction indicated by an arrow in FIG. 2. The fixing belt 21 has a multi-layer structure including a base layer, an elastic layer disposed on the base layer, and a surface releasing layer disposed on the elastic layer. The total thickness of the fixing belt 21 is no more than 1 mm.

The base layer of the fixing belt 21 has a thickness in a range from 30 μm to 50 μm, and is formed of, for example, metal such as nickel and stainless steel, and resin material including, but not limited to, polyimide, polyamide, and polyamideimide.

The elastic layer of the fixing belt 21 includes a rubber material such as silicon rubber, silicon rubber foam, and fluorocarbon rubber. The thickness of the elastic layer is in a range from approximately 100 μm to 300 μm. The elastic layer prevents or reduces the effects of slight surface asperities of the fixing belt 21 in the nip between the fixing belt 21 and the pressing roller 31. Accordingly, heat is uniformly transmitted from the fixing belt 21 to a toner image T on a recording medium P, suppressing formation of defective rough images with the appearance of an orange peel.

The releasing layer of the fixing belt 21 has a thickness of in a range from approximately 10 μm to 50 μm. The releasing layer of the fixing belt 21 includes, but is not limited to, tetrafluoroethylene-perfluoroalkylvinylether copolymer (PFA), polytetrafluoroethylene (PTFE), polyimide, polyetherimide, and polyether sulfide (PES). The releasing layer releases or separates the toner image T from the fixing belt 21.

According to the illustrative embodiment, the fixing belt 1 has a diameter of approximately 30 mm. In the inner loop (on the inner circumference side) of the fixing belt 21 includes the heater 25, the nip forming member 23, and the reinforcing member 24.

The nip forming member 23 is disposed inside the loop formed by the fixing belt 21 and is fixed to the inner circumferential surface of the fixing belt 21 such that the nip forming member 23 contacts the pressing roller 31 through the fixing belt 21, thereby forming the nip.

According to the illustrative embodiment, the surface of the nip forming member 23 facing the pressing roller 31 has a curved shape having a curvature similar to the curvature of the pressing roller 31, thereby discharging the recording medium P in accordance with the curvature of the pressing roller 31 and thus preventing the recording medium P from sticking to the fixing belt 21 even after the fixing process. Preferably, a surface of the nip forming member 23 contacting the fixing belt 21 is made of material having a low friction coefficient to reduce friction between the nip forming member 23 and the fixing belt 21.

The reinforcing member 24 is disposed inside the loop of the fixing belt 21 and is fixed to the inner circumferential surface of the fixing belt 21. The reinforcing member 24 reinforces strength of the nip forming member 23 at the nip. The reinforcing member 24 has a length in the width direction similar to the nip forming member 23. Both end portions of the reinforcing member 24 in the width direction are supported by side plates of the fixing device 20.

The reinforcing member 24 contacts the pressing roller 31 through the nip forming member 23 and the fixing belt 21, thereby preventing deformation of the nip forming member 23 at the nip due to pressure of the pressing roller 31.

In view of the above, the reinforcing member 24 is formed of, for example, a metal such as stainless steel or iron having strength sufficient to reinforce the nip forming member 23. Further, the reinforcing member 24 is horizontally long in cross-section along the direction of pressure of the pressing roller 31, thereby increasing a section modulus and thus enhancing the strength of the reinforcing member 24.

According to the present illustrative embodiment, a resistance heater is used as the heater 25. The heater 25 can change the distribution of heat emission of the fixing belt 21 in the width direction in at least two different patterns, as described below.

According to the illustrative embodiment, the heater 25 includes two different heat-generating sections in the width direction of the fixing belt 21. More specifically, the heater 25 includes the first heat generator 25*a* and the second heat generator 25*b*. The first heat generator 25*a* emits heat in an area corresponding to the recording medium passing area that accommodates an A4-portrait recording medium having a width of approximately 210 mm. The second heat generator 25*b* heats the fixing belt 21 at both sides in the width direction outside the recording medium passing area having the width of the A4-portrait recording medium.

Both end portions of the first heat generator 25*a* in the width direction are connected to a power source 50*a* through electrodes 51*a*. Both end portions of the second heat generator 25*b* in the width direction are connected to power sources 50*b* through electrodes 51*b*. In this configuration, as power is supplied from the power sources 50*a* and 50*b* to the first and the second heat generators 25*a* and 25*b*, the electrical resistance of the first and the second heat generators 25*a* and 25*b* causes the temperature of the first and the second heat generators 25*a* and 25*b* to increase. Accordingly, the first and the heat generators 25*a* and 25*b* heat the fixing belt 21.

A relatively wide area of the fixing belt 21 except the nip portion thereof, at which the nip forming member 23 is disposed, is heated by the heat generators 25*a* and 25*b*, thereby heating the toner image on the recording medium P.

The first temperature detector 37 is disposed in the inner loop of the fixing belt 21, substantially at a lateral end side of the fixing belt 21 in the width direction thereof, and contacts a surface of the heater 25 opposite the surface facing the fixing belt 21. In other words, the first temperature detector 37 contacts the rear surface of the heater 25. The second temperature detector 35 is disposed in the inner loop of the fixing belt 21, substantially at the lateral center of the fixing belt 21 in the width direction thereof, and is positioned so as to contact the inner circumferential surface of the fixing belt 21 at any place therealong except the place where the heater 25 is disposed.

As illustrated in FIG. 2A, it is preferable to dispose the second temperature detector 35 between the heater 25 and the nip in the direction of movement of the fixing belt 21. In this configuration, the second temperature detector 35 detects the temperature of the fixing belt 21 before the fixing belt 21 arrives at the nip, but after the fixing belt 21 is heated by the heater 25. Accordingly, the temperature of the fixing belt 21 can be reliably adjusted before the fixing belt 21 arrives at the nip, thereby achieving reliable fixation of the toner image on the recording medium.

Furthermore, because the second temperature detector 35 is disposed between the heater 25 and the nip forming member 23 and substantially near the nip forming member 23, the temperature of the fixing belt 21 is detected immediately before the fixing belt 21 arrives at the nip. With this configuration, the temperature of the rotating fixing belt 21 just before the fixing belt 21 comes into contact with the toner image can be adjusted precisely to an optimal temperature.

According to the illustrative embodiment, in the fixing device 20, output of the power source 50*b* is adjusted based on the results provided by the first temperature detector 37. Output of the power source 50*a* is adjusted based on the result provided by the second temperature detector 35. In this configuration, power is supplied independently to the first heat generator 25*a* and the second heat generator 25*b*. Further, the temperature of the fixing belt 21 is adjusted to a desired optimal temperature (fixation temperature) by adjusting the output of the power source 50*a* and the power source 50*b*.

As illustrated in FIGS. 2A and 2B, when the recording medium P having a width no more than the size of A4-portrait is fed, only the first heat generator 25*a* generates heat while the second heat generator 25*b* does not generate heat. Accordingly, the temperature of the portion of the fixing member 21 corresponding to the non-recording medium passing area where no recording medium contacts is prevented from rising undesirably.

The heater 25 includes the second heat generators 25*b* each disposed at both lateral sides of the first heat generator 25*a* in the width direction. Alternatively, the heater 25 may include more than two heat generators having different distribution patterns of heat generation so that the heater 25 may accommodate recording media sheets in various sizes. In accordance with the size of the recording medium, the distribution pattern of the heat generation is changed by adjusting output of the power source.

Both lateral end portions of the heater 25 in the width direction are fixed to side plates (frames) of the fixing device 20 through a holder. Alternatively, as will be later described, the heater 25 may be supported by using a pipe-shape support 29 shown in FIG. 5.

In a case in which a resistant heat generator, which changes its resistance in accordance with the temperature of the heater 25, is used as the temperature detector, a contact-type thermistor is generally used to detect the temperature. Alternatively, the temperature of the heater 25 is predicted by measuring electric current in the heater 25.

It is preferable to provide a clearance δ or a space between the fixing belt 21 and the heater 25. For example, the clearance may be within a range of $0\ \text{mm} \leq \delta \leq 1\ \text{mm}$. In this configuration, the heater 25 and the fixing belt 21 are close enough to maintain good heating efficiency while friction resistance is low.

The surface of the heater 25 contacting the fixing belt 21 may be formed of material having a low friction coefficient to reduce friction of the fixing belt 21. For example, if the clearance is 0 mm, the contact pressure of the heater 25 and the fixing belt 21 is equal to or less than 0.3 $\text{kgf/cm}^2$.

With reference to FIG. 2A, a description is provided of the pressing roller 31 serving as a pressing member. The pressing roller 31 has a diameter of approximately 30 mm, for example, and includes a hollow metal core 32 on which an elastic layer 33 is disposed. The elastic layer 33 of the pressing roller 31 includes rubber material such as silicon rubber, silicon rubber foam, and fluorocarbon rubber. A thin releasing layer may be provided on the elastic layer 33. The releasing layer of the pressing roller 31 includes, but is not limited to, tetrafluoroethylene-perfluoroalkylvinylether copolymer (PFA) and polytetrafluoroethylene (PTFE). The pressing roller 31 presses against and contacts the fixing belt 21, thereby forming the nip.

The pressing roller 31 is rotated in the clockwise direction indicated by an arrow in FIG. 2. The pressing roller 31 may include a heat source such as a halogen heater inside the pressing roller 31.

According to the illustrative embodiment, the diameter of the fixing belt 21 in its operational, looped shape is similar to, if not the same as, that of the pressing roller 31. Alternatively, the diameter of the fixing belt 21 in its operational, looped shape may be smaller than that of the pressing roller 31. In this configuration, the curvature of the fixing belt 21 at the nip is less than that of the pressing roller 31, thereby facilitating separation of the recording medium P from the fixing belt 21 as the recording medium P is discharged from the nip.

Next, a description is provided of operation of the fixing device 20. When a power of the main body 1 is turned on, power is supplied to the heater 25 and the pressing roller 31 starts to rotate in the direction indicated by the arrow in FIG. 2, enabling the fixing belt 21 to rotate due to friction with the pressing roller 31.

Subsequently, the recording medium P is fed from one of the sheet cassettes 12, 13, and 14 to the image forming units 4 in which an unfixed toner image T is transferred onto the recording medium P. The recording medium P bearing the unfixed toner image T, also known as a toner image, is conveyed by a guide plate to the nip at which the fixing belt 21 and the pressing roller 31 meet and press against each other.

In the nip, the toner image T is fixed onto the recording medium P by heat from the fixing belt 21 heated by the heater 25 and pressure of the pressing roller 31 supported by the nip forming member 23 reinforced by the reinforcing member 24.

According to the illustrative embodiment, a controller 40 of the fixing device 20 enables following operation.

When the fixing belt 21 is not rotated, for example, at initialization of warm-up, the second temperature detector 35 does not detect the temperature of the fixing belt 21, but the output of the power source 50*a* for the first heat generator 25*a* and the power sources 50*b* for the second heat generators 25*b* are adjusted by using the first temperature detector 37. For example, when the temperature detected by the first temperature detector 37 is less than a predetermined value, the power sources 50*a* and 50*b* are turned on. By contrast, when the temperature detected by the first temperature detector 37 is equal to or more than a predetermined value, the power sources 50*a* and 50*b* are turned off.

It is to be noted that one example of heating the fixing belt 21 while the fixing belt 21 is not rotated includes an initialization of warm-up.

In order to enhance slidability of the nip forming member 23, a lubricant such as grease may be applied to the inner circumferential surface of the fixing belt 21. When applying grease on the fixing belt 21, warm grease is preferably used because warm grease is relatively soft and hence viscosity and slide resistance thereof are reduced. Accordingly, a torque error is prevented.

In light of the above, it is preferable to start rotation of the fixing device 21 after the fixing belt 21 is heated to some extent while the fixing belt 21 is not rotated. At the beginning of warm-up, the fixing belt 21 is heated while the fixing belt 21 is not rotated, thereby preventing heat of the fixing belt 21 from dissipating to the pressing roller 31 and thus reducing warm-up time.

In a case in which the fixing belt 21 rotates very slow, for example, the fixing belt 21 rotates at a peripheral velocity in a range from 10 to 20 mm/sec so that it takes a few seconds for the fixing belt 21 to arrive at the second temperature detector 35 after passing the first temperature detector 37, the controller 40 may consider the fixing belt 21 as being not rotating and hence adjust the output of the power sources 50*a* and 50*b* using the first temperature detector 37.

By contrast, when the fixing belt 21 rotates, the output of the power sources 50*a* and 50*b* for both the first and the second heat generators 25*a* and 25*b* are adjusted by using the second temperature detector 35. With this configuration, the temperature of the fixing belt 21 is directly measured, and the controllability of the temperature of the fixing belt 21 is thus improved. An amount of heat supplied to the toner image is stabilized, thereby achieving reliable fixation quality.

It should be noted that when a recording medium having the width equal to or less than an A4-portrait size is fed, power is not supplied to the second heat generator 25*b* regardless of the temperature detected by the second temperature detector 35.

In a case in which the temperature detected by the first temperature detector 37 is equal to or greater than the predetermined value which is determined by a heat-resistant temperature of the fixing member 21, intervals between the previous and the subsequent recording media sheets may be extended intentionally to reduce productivity. Accordingly, the temperature of the fixing belt 21 is prevented from rising continuously.

According to the illustrative embodiment, the fixing device 20 prevents the fixing belt 21 from getting heated partially. The heater 25 heats a wide area of the fixing belt 21 in the circumferential direction. Even when operating at a high speed, the fixing belt 21 is heated adequately, preventing fixing failure. In other words, the fixing belt 21 is heated efficiently with a relatively simple configuration, thereby reducing warm-up time and first print time required to process an initial print job.

According to the illustrative embodiment, the first temperature detector 37 and the second temperature detector 35 are disposed at different positions, different in both the circumference direction and the axial direction. In this configuration, when the fixing belt 21 is rotated, the temperature of the fixing belt 21 is detected directly. By contrast, when the fixing belt 21 is not rotated, the temperature of the fixing belt 21 is adjusted by detecting the temperature of the heater 25, thereby adjusting the temperature of the fixing belt 21 safely and preventing the temperature ripple. Furthermore, the temperature of the fixing belt 21 is adjusted immediately before the fixing belt 21 contacts the toner image. Hence, the toner image is fixed reliably at a desired temperature.

According to the illustrative embodiment, when feeding a recording medium having a narrow width, the fixing device 20 prevents the end portions of the fixing belt 21 from getting overheated by using the first temperature detector 37 which detects the temperature of the end portions of the heater 25, thereby maintaining productivity. Providing only two temperature detectors such as the first temperature detector 37 substantially at the end portion in the width direction and the second temperature detector 35 substantially at the center in the width direction enables detection of failure in the heater 25, for example, disconnection of the heater 25, with a simple configuration at low cost. Because the temperature of the fixing belt 21 is detected from the inner circumferential surface of the fixing belt 21, a contact-type temperature detector is used, thereby reducing the cost. Because the heater 25 employs a resistant heat generator to heat the fixing belt 21, the fixing belt 21 is heated efficiently at low cost.

Figure 3:
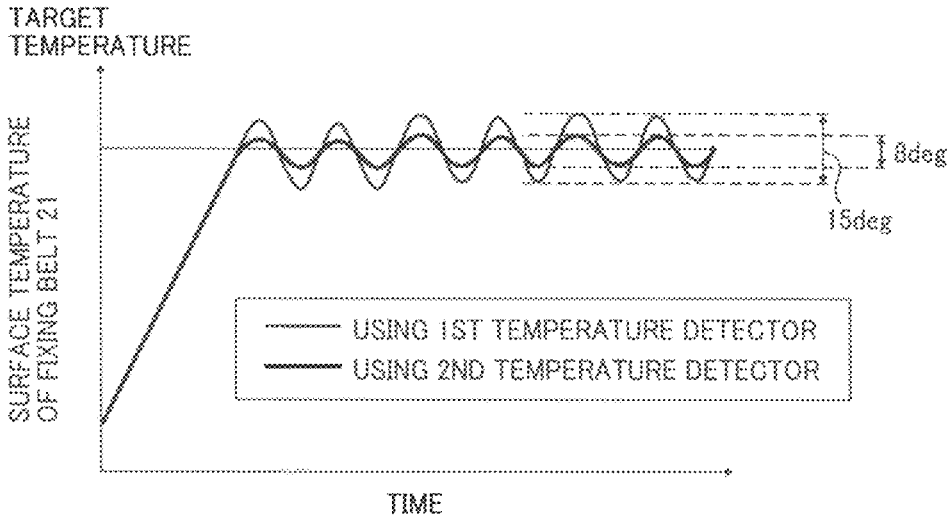
FIG. 3 is a temperature profile of a fixing belt employed in the fixing device of FIG. 2, when a temperature of the fixing belt is adjusted by a first temperature detector and a second temperature detector according to an illustrative embodiment of the present invention.

Referring now to FIG. 3, a description is provided of an example of a temperature profile of the surface of the fixing belt 21 immediately before the nip when the temperature is adjusted by the second temperature detector 35 and by the first temperature detector 37 as an A4-landscape recording medium having a width of approximately 297 mm is fed.

When adjusted by the first temperature detector 37 which adjusts the temperature of the fixing belt 21 via the heat generator 25, the temperature ripple of 15 degrees occurred. By contrast, when controlled by the second temperature detector 35 which adjusts the temperature of the fixing belt 21 directly, the temperature ripple of 8 degrees occurred. That is, the temperature ripple is reduced.

According to the foregoing embodiments, the pressing roller 31 is employed as a pressing member. However, the pressing member is not limited to a roller. Alternatively, the pressing member may employ a belt or a pad.

Furthermore, the foregoing embodiments pertain to a fixing device using the fixing belt 21 having a multi-layer structure serving as a fixing member. However, the fixing member is not limited to a belt-type fixing member. Alternatively, a film-type endless fixing member including, but not limited to, polyimide, polyamide, fluorocarbon resin, and metal, may be used.

Preferably, the heat generator 25 has a predetermined Curie point which is a maximum threshold temperature at which the temperature of the heat generator 25 stops rising due to a rapid change in the resistant value of the resistance heater. In such a case, if the temperature of the heat generator 25 does not reach the Curie point (at a normal case) and the electric current is supplied to the heat generator 25, the temperature of the heat generator 25 increases, thereby heating the fixing belt 21 at a certain temperature.

By contrast, when the temperature of the heat generator 25 reaches the Curie point, the resistance of the heat generator 25 increases rapidly, hindering the flow of the electric current to the heat generator 25. Hence, the heat generator 25 is not overheated, preventing overheating of the fixing belt 21. With this configuration, even when a small-size recording medium is fed, the fixing belt 21 (heat generator 25) is prevented from getting overheated locally. It is to be noted that the Curie point of the heat generator 25 may be set at a maximum temperature at which offset does not occur on an output image (for example, 180° C.). Because the heat generator 25 includes multiple heat generating portions (for example, the heat generator 25*a* and 25*b*) having the Curie point in the width direction, the image forming apparatus can accommodate various sizes of recording media sheets without damaging the fixing member, thereby improving productivity.

Figure 4:
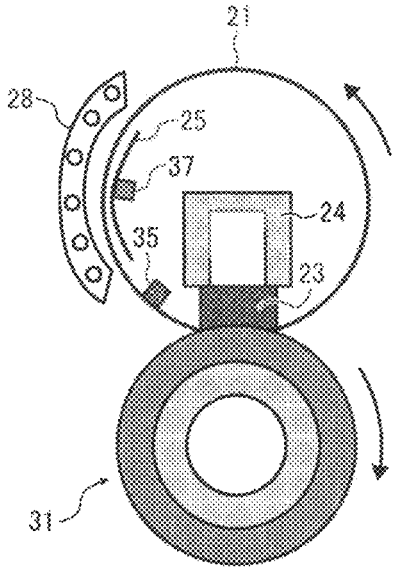
FIG. 4 is a schematic cross-sectional diagram illustrating a fixing device according to another illustrative embodiment of the present invention.

With reference to FIG. 4, a description is provided of a fixing device according to another illustrative embodiment. FIG. 4 is a schematic cross-sectional diagram illustrating a fixing device using an induction heating (hereinafter referred to as IH) coil 28. According to the present embodiment, the IH coil 28 serving as an electromagnetic induction member may be used to enable the heat generator 25 to generate heat. In this configuration, heat is produced more efficiently.

Figure 5:
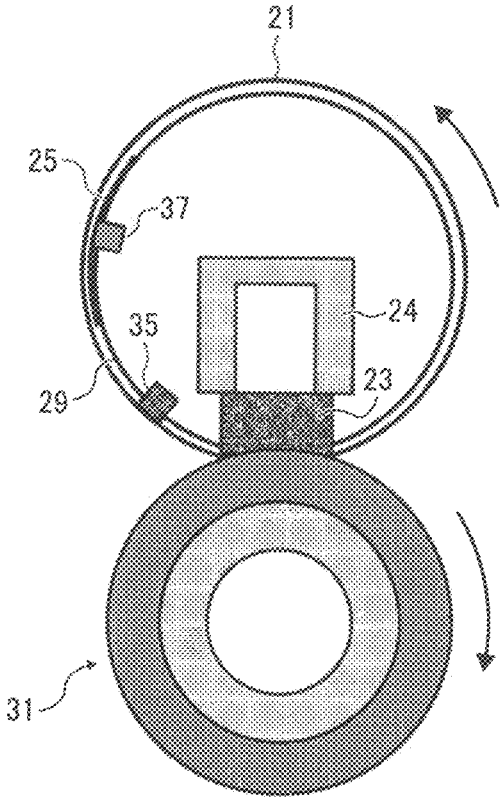
FIG. 5 is a schematic cross-sectional diagram illustrating a fixing device according to still another illustrative embodiment of the present invention.

With reference to FIG. 5, a description is provided of still another illustrative embodiment of a fixing device. FIG. 5 is a schematic cross-sectional diagram illustrating a fixing device using a support 29 to support the heat generator 25. The support 29 is a pipe disposed in the vicinity of the inner circumferential surface of the fixing belt 21. In this configuration, a portion of the support 29 has a notch or a shaped cut at which the second temperature detector 35 is disposed to contact directly the rear surface of the fixing belt 21. Similarly, the support 29 may support the first temperature detector 37 to contact the rear surface of the heat generator 25 as illustrated in FIG. 5.

Preferably, the support 29 is formed of a heat insulating material, thereby preventing heat from the heat generator 25 to dissipate inside the support 29. Accordingly, the fixing belt 21 is heated efficiently by the heat generator 25. Further, because the support 29 is a pipe member supporting the heat generator 25, the heat generator 25 itself does not need strength. Thus, it is possible to make the heat capacity of the heat generator 25 small, thereby reducing the rise time of the heat generator 25 required to reach a desired temperature.

The portion of the support 29 corresponding to the recording medium passing area, which is substantially at the center in the axial direction, includes an opening at which the nip forming member 23 is disposed. Preferably, however, the nip forming member 23 is fixed only to the reinforcing member 24, but is not fixed to the support 29. The nip forming member 23 may deform when pressed by the pressing roller 31. Being fixed only to the reinforcing member 24, the nip forming member 23 does not cause the support 29 to deform even when the nip forming member 23 deforms.

According to the illustrative embodiment, the present invention is employed in the image forming apparatus. The image forming apparatus includes, but is not limited to, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device for fixing a toner image on a recording medium, comprising:

an endless belt-shaped fixing member formed in a loop, to rotate in a predetermined direction and convey the recording medium;

a pressing member disposed opposite the fixing member, to press against the fixing member to contact an outer circumferential surface of the fixing member;

a nip forming member disposed inside the loop formed by the fixing member, to contact the pressing member through the fixing member to form a nip portion between the pressing member and the fixing member through which the recording medium bearing the toner image passes;

a heat generator disposed inside the loop formed by the fixing member outside the nip portion to heat the fixing member, the heat generator having variable heat distribution over a width of the fixing member; and a first temperature detector and a second temperature detector, the first and second temperature detectors provided as the only temperature detectors disposed inside the loop formed by the fixing member, wherein the first temperature detector contacts a lateral end portion of the heat generator in the width direction of the fixing member opposite a surface of the heat generator facing the fixing member, to detect a temperature of the heat generator, and wherein the second temperature detector contacts a lateral center portion of an inner circumferential surface of the fixing member in the width direction, to detect the temperature of the fixing member.

2. The fixing device according to claim 1, wherein the heat generator includes a surface contacting the fixing member, and the first temperature detector is disposed inside the loop formed by the fixing member to contact the lateral end portion of the heat generator in the width direction of the fixing member opposite the surface contacting the fixing member.

3. The fixing device according to claim 1, wherein the second detector contacts the inner circumferential surface of the fixing member between the heat generator and the nip portion.

4. The fixing device according to claim 1, wherein the fixing member rotates when the temperature detected by the first temperature detector exceeds a predetermined threshold temperature.

5. The fixing device according to claim 1, wherein the heat generator is a resistance heater.

6. The fixing device according to claim 1, further comprising an electromagnetic induction member to enable the heat generator to generate heat.

7. The fixing device according to claim 1, further comprising a support member to assist rotation of the fixing member rotated by the pressing member and to hold the heat generator in place.

8. An image forming apparatus comprising:

an image carrier to bear an electrostatic latent image on a surface thereof;

a developing device to develop the electrostatic latent image formed on an image bearing member using toner to form a toner image;

a transfer device to transfer the toner image onto a recording medium; and a fixing device to fix the toner image on the recording medium, the fixing device including an endless belt-shaped fixing member formed in a loop, to rotate in a predetermined direction and convey the recording medium;

a pressing member disposed opposite the fixing member, to press against the fixing member to contact an outer circumferential surface of the fixing member;

a nip forming member disposed inside the loop formed by the fixing member, to contact the pressing member through the fixing member to form a nip portion between the pressing member and the fixing member through which the recording medium bearing the toner image passes;

a heat generator disposed inside the loop formed by the fixing member outside the nip portion to heat the fixing member, the heat generator generating variable heat distribution over a width of the fixing member; and a first temperature detector and a second temperature detector, the first and second temperature detectors provided as the only temperature detectors disposed inside the loop formed by the fixing member, wherein the first temperature detector contacts a lateral end portion of the heat generator in the width direction of the fixing member opposite a surface of the heat generator facing the fixing member, to detect a temperature of the heat generator, and wherein the second temperature detector contacts a lateral center portion of an inner circumferential surface of the fixing member in the width direction, to detect the temperature of the fixing member.

9. The fixing device according to claim 1, wherein when the fixing member does not rotate, the temperature of the fixing member is controlled based on the detection results provided by the first temperature detector, and when the fixing member rotates, the temperature of the fixing member is controlled based on the detection results provided by the second temperature detector.

10. The image forming apparatus according to claim 8, wherein when the fixing member does not rotate, the temperature of the fixing member is controlled based on the detection results provided by the first temperature detector, and when the fixing member rotates, the temperature of the fixing member is controlled based on the detection results provided by the second temperature detector.

* * * * *